US009128470B2

(12) United States Patent
Yanagisawa et al.

(10) Patent No.: US 9,128,470 B2
(45) Date of Patent: Sep. 8, 2015

(54) ELECTRONIC TIMEPIECE WITH BUILT-IN ANTENNA

(71) Applicant: SEIKO EPSON CORPORATION, Tokyo (JP)

(72) Inventors: Toshiaki Yanagisawa, Suwa (JP); Toshitaka Nagahama, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/381,109

(22) PCT Filed: Feb. 22, 2013

(86) PCT No.: PCT/JP2013/001032

§ 371 (c)(1),
(2) Date: Aug. 26, 2014

(87) PCT Pub. No.: WO2013/128865

PCT Pub. Date: Sep. 6, 2013

(65) Prior Publication Data

US 2015/0016229 A1 Jan. 15, 2015

(30) Foreign Application Priority Data

Feb. 29, 2012 (JP) ..... 2012-042878
Mar. 2, 2012 (JP) ..... 2012-047261

(51) Int. Cl.

| | |
|---|---|
| ***G04R 60/10*** | (2013.01) |
| ***G04R 60/12*** | (2013.01) |
| ***G04G 17/04*** | (2006.01) |
| ***G04R 20/02*** | (2013.01) |

(52) U.S. Cl.

CPC ..... *G04R 60/10* (2013.01); *G04G 17/045* (2013.01); *G04R 20/02* (2013.01); *G04R 60/12* (2013.01)

(58) Field of Classification Search

CPC ..... G04G 21/04; G04G 17/045; G04R 20/02; G04R 60/06; G04R 60/10; G04R 60/12; H01Q 1/273

USPC ..... 368/47

See application file for complete search history.

(56) References Cited

U.S. PATENT DOCUMENTS

| | | | | |
|---|---|---|---|---|
| 5,331,608 | A * | 7/1994 | Umemoto et al. | 368/10 |
| 5,367,502 | A * | 11/1994 | Barroso et al. | 368/10 |
| 5,768,217 | A | 6/1998 | Sonoda et al. | |
| 5,963,181 | A * | 10/1999 | Abe | 343/895 |
| 2009/0161491 | A1 * | 6/2009 | Someya et al. | 368/47 |

(Continued)

FOREIGN PATENT DOCUMENTS

| | | | |
|---|---|---|---|
| JP | H07-280967 | A | 10/1995 |
| JP | H09-307329 | A | 11/1997 |
| JP | H10-197662 | A | 7/1998 |

(Continued)

*Primary Examiner* — Vit W Miska

(74) *Attorney, Agent, or Firm* — Harness, Dickey & Pierce, P.L.C.

(57) ABSTRACT

An electronic timepiece includes a tubular exterior case, a cover glass plate that blocks one of two openings of the exterior case, a ring-shaped antenna body provided along an inner circumference of the exterior case, a circuit substrate which is provided in a position below the antenna body when viewed from the cover glass plate and on which a shield pattern G is formed, and a GPS receiver that is so provided on the circuit substrate that the GPS receiver faces away from the antenna body with the shield pattern G being a boundary and amplifies and processes a signal received by the antenna body.

12 Claims, 14 Drawing Sheets

(56) References Cited

U.S. PATENT DOCUMENTS

| | | | | |
|---|---|---|---|---|
| 2009/0201769 | A1* | 8/2009 | Miyahara | 368/10 |
| 2009/0201771 | A1* | 8/2009 | Miyahara | 368/47 |

FOREIGN PATENT DOCUMENTS

| | | | |
|---|---|---|---|
| JP | 2004-264288 | A | 9/2004 |
| JP | 2012118045 | A | 6/2012 |

* cited by examiner

ELECTRONIC TIMEPIECE WITH BUILT-IN ANTENNA

CROSS-REFERENCE TO RELATED APPLICATIONS

This application is a U.S. National Phase Application of PCT/JP2013/001032, filed on Feb. 22, 2013, and published in Japanese as WO 2013/128865 on Sep. 6, 2013. This application claims priority to Japanese Application No. 2012-042878, filed on Feb. 29, 2012 and Japanese Application No. 2012-047261, filed on Mar. 2, 2012. The entire disclosures of the above applications are incorporated herein by reference.

TECHNICAL FIELD

The present invention relates to an electronic timepiece with a built-in antenna or an electronic timepiece in which an antenna is built.

BACKGROUND ART

There is a known portable electronic timepiece that receives a weak electromagnetic wave, for example, from a GPS (global positioning system) satellite for time correction. In such a portable electronic timepiece, an antenna and a receiver need to be arranged in positions close to each other from a viewpoint of compactness of the timepiece. On the other hand, the arrangement may cause noise produced by the receiver to be inputted to the antenna in some cases. The portable electronic timepiece therefore undesirably experiences a decrease in the SN ratio of a received electromagnetic wave and is hence not capable of accurate time correction.

JP-A-10-197662 discloses a technology in which, in a portable electronic timepiece using a patch antenna, the patch antenna, an analog circuit portion, and a digital circuit portion are disposed on a circuit substrate having a shield layer to electromagnetically isolate the front and rear sides of the circuit substrate, thereby improving the SN ratio of an electromagnetic wave received by the portable electronic timepiece.

SUMMARY OF INVENTION

Technical Problem

In the portable electronic timepiece of the related art, which employs a box-shaped patch antenna, however, part of the circuit portions needs to be disposed on the side where the patch antenna is disposed from a viewpoint of compactness of the timepiece. As a result, the portable electronic timepiece of the related art, in which the shield layer may isolate the front and rear sides of the circuit substrate from each other, undesirably causes noise to be inputted to the patch antenna from the circuit portion disposed on the side where the patch antenna is disposed.

The invention has been made in view of the circumstances described above, and an object to be achieved is an improvement in space usage efficiency, a decrease in the amount of noise inputted to an antenna, and others.

Solution to Problem

To achieve the object described above, an electronic timepiece with a built-in antenna according to the invention includes a tubular exterior case, a cover glass plate that blocks one of two openings of the exterior case, a ring-shaped antenna body provided along an inner circumference of the exterior case, indication hands that are disposed in a portion inside an inner circumference of the antenna body and display time, a circuit substrate which is provided in a position below the antenna body when viewed from the cover glass plate and on which a shield pattern is formed, and a receiver that is so provided on the circuit substrate that the receiver faces away from the antenna body with the shield pattern being a boundary and amplifies and processes a signal received by the antenna body.

According to the invention, the ring-shaped antenna body is provided along the inner circumference of the exterior case, the indication hands and a variety of other structures can be disposed in a portion inside the antenna body, whereby space usage efficiency is improved. Further, since the receiver is so disposed that it faces away from the ring-shaped antenna body with the shield pattern being a boundary, noise produced by the receiver is not inputted to the ring-shaped antenna body.

In the electronic timepiece with a built-in antenna described above, the receiver is preferably disposed in a position inside the inner circumference of the antenna body. According to the invention, noise produced by the receiver detours around the outer circumference of the circuit substrate and reaches the ring-shaped antenna body. However, since the receiver is disposed in a position inside the inner circumference of the antenna body, the distance from the receiver to the antenna body can be longer than in a case where the receiver is disposed in a position immediately below the antenna body. As a result, the invention allows reduction in the amount of noise inputted to the antenna body.

The electronic timepiece with a built-in antenna described above preferably further includes a pair of feed points provided on the ring-shaped antenna body, a pair of connection pins that connect the pair of feed points to the circuit substrate, and a balun so disposed on the circuit substrate that the balun and the receiver are present on the same side with the balun electrically connected to the pair of connection pins, and the receiver is preferably disposed in a position closer to the center of the ring-shaped antenna body than the balun.

According to the invention, noise produced by the receiver detours around the outer circumference of the circuit substrate and reaches the ring-shaped antenna body. However, since the receiver is disposed in a position closer to the center of the ring-shaped antenna body than the balun, the distance from the receiver to the antenna body can be longer than in a case where the balun and the receiver are so disposed that they are equally set apart from the center of the ring-shaped antenna body. As a result, the invention allows reduction in the amount of noise inputted to the antenna body.

Further, the balun is preferably disposed in a position inside the inner circumference of the ring-shaped antenna body.

The electronic timepiece with a built-in antenna described above further includes a main plate accommodated in the exterior case, a reference surface that is formed on the main plate and positions the antenna body in a direction perpendicular to the main plate, an urging member that is attached to the main plate and engages with the antenna body to urge the antenna body toward the reference surface, and an engaging portion that is formed on the antenna body and engages with the urging member, and a predetermined gap is formed between the antenna body and a structure above the antenna body in a normal state.

In the electronic timepiece with a built-in antenna described above, the urging member is attached to the main plate, and the urging member engages with the engaging portion of the antenna body. The antenna body is placed on the reference surface formed on the main plate and urged by the urging member toward the reference surface. In a normal state, a predetermined gap is formed between the antenna body and the structure above the antenna body.

Therefore, according to the invention, even when the antenna body is displaced in the vertical direction, the amount of displacement of the antenna body is limited by the structure above the antenna body. Therefore, according to the invention, even when the antenna body is made of a composite material that is a combination of a dielectric material and a plastic material and formed to have a ring-like shape that cannot be fixed to a base with an adhesive, breakage of the antenna body can be reliably avoided.

In the electronic timepiece with a built-in antenna described above, the gap may be set at a value within a range over which the urging member elastically deforms when the antenna body is so displaced that the antenna body comes into contact with the structure above the antenna body. The setting described above allows the antenna body, when it is so displaced that it comes into contact with the structure above the antenna body, to return by an elastic force produced by the urging member to the position of the antenna body in the normal state. Therefore, even when the antenna body is made of a composite material that is a combination of a dielectric material and a plastic material and formed to have a ring-like shape that cannot be fixed to a base with an adhesive, breakage of the antenna body can be reliably avoided.

In the electronic timepiece with a built-in antenna described above, the urging member may be so attached to the main plate that the urging member is in intimate contact with the main plate partially in a circumferential direction of the main plate, and the position where the urging member is attached and the position where the urging member engages with the engaging portion of the antenna body may be so set that the positions are kept apart from each other by a predetermined distance in the circumferential direction of the main plate. The setting described above allows the urging member to elastically deform. Therefore, according to the invention, even when the position of the antenna body is changed, the antenna body is allowed to return to the position in the normal state, whereby breakage of the antenna body can be reliably avoided.

In the electronic timepiece with a built-in antenna described above, the main plate may have first guide engaging portions formed at a plurality of locations in a circumferential direction of the main plate, and the antenna body may have second guide engaging portions that engage with the first guide engaging portions. Further, the main plate may have main plate perpendicular surface portions that face an inner circumferential surface of the ring-shaped antenna body at a plurality of locations in the circumferential direction of the main plate, and the antenna body may have antenna perpendicular surface portions formed as part of the inner circumferential surface of the antenna body in positions that face the main plate perpendicular surface portions. A gap between each of the main plate perpendicular surface portions and the corresponding antenna perpendicular surface portion is preferably set to be smaller than a gap between each of the first guide engaging portions and the corresponding second guide engaging portion. The setting described above allows, even when the position of the antenna body is changed in the planar direction of the main plate, the main plate perpendicular surfaces to limit the amount of shift of the antenna body. The invention therefore reliably prevents breakage of the antenna body.

Further, each of the first guide engaging portions may be an antenna body guide protrusion that is formed to protrude from the main plate in a direction perpendicular thereto or in a radial direction thereof, and each of the second guide engaging portions may be a recess that engages with the corresponding antenna body guide protrusion. The antenna body can therefore be readily positioned in the planar and circumferential directions of the main plate.

In the electronic timepiece with a built-in antenna described above, the urging member may be a ring-shaped plate. The thus shaped urging member can be disposed in a position below the antenna body, whereby the antenna body is reliably allowed to return to the position thereof in the normal state without an increase in the size of the timepiece.

DESCRIPTION OF EMBODIMENTS

Figure 1:
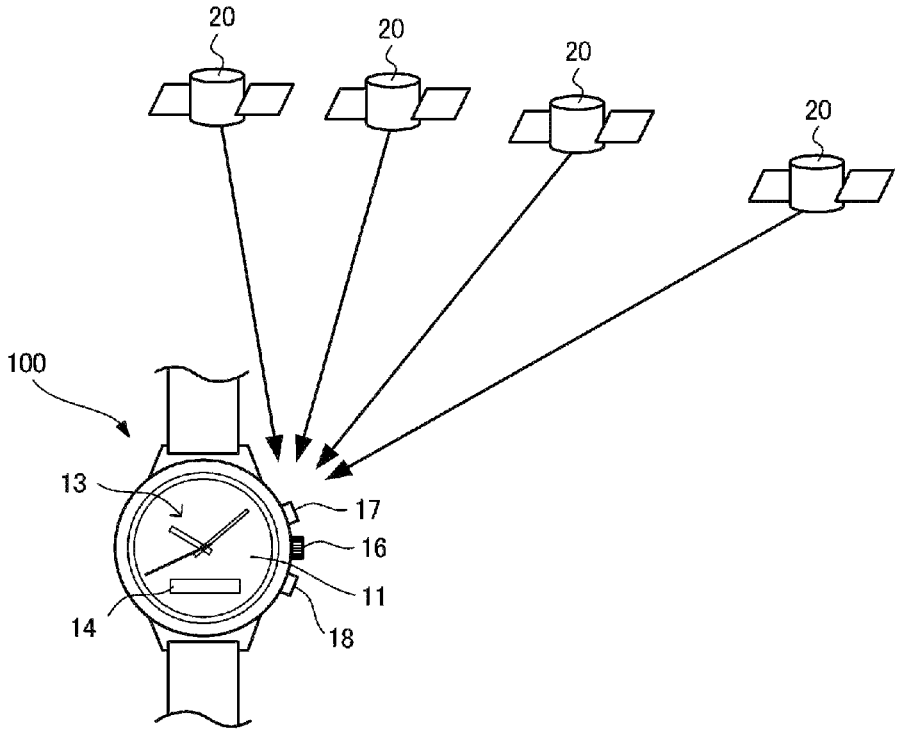
FIG. 1 is an overall view of a GPS system including an electronic timepiece 100 with a built-in antenna according to an embodiment of the invention.

Preferable embodiments of the invention will be explained below in detail with reference, for example, to the accompanying drawings. In the drawings, the dimension and scale of each portion differ from an actual dimension and scale as appropriate. Further, since the embodiments that will be described below are preferable specific examples of the invention, a variety of technically preferable restrictions are imposed thereon, but the scope of the invention is not limited to the embodiments unless the following explanation includes a particular description of limitation of the invention.

First Embodiment

FIG. 1 is an overall view of a GPS system including an electronic timepiece 100 with a built-in antenna (hereinafter referred to as "electronic timepiece 100") according to an embodiment of the invention. The electronic timepiece 100 is a wristwatch that receives an electromagnetic wave (wireless signal) from a GPS satellite 20 to correct internal time and displays time on the side (hereinafter referred to as "front side") of the timepiece that faces away from the side in contact with a wrist (hereinafter referred to as "rear side").

The GPS satellite 20 is a position information satellite that goes along a predetermined orbit around the earth up in the sky and transmits a 1.57542-GHz electromagnetic wave (L1 wave) with a navigation message superimposed thereon to the ground. In the following description, the 1.57542-GHz electromagnetic wave with a navigation message superimposed thereon is referred to as a "satellite signal." The satellite signal is formed of a right-handed circularly polarized wave.

At present, approximately 31 GPS satellites are present. FIG. 1 shows only four of the approximately 31 satellites. To distinguish which of the GPS satellites 20 has transmitted a satellite signal received by the electronic timepiece 100, each of the GPS satellites 20 superimposes a specific pattern, which is called a C/A code (coarse/acquisition code) formed of 1023 chips (and having a period of 1 ms), on the satellite signal. The C/A code, in which each of the chips is either +1 or −1, appears to be a random pattern. Examining correlation between a satellite signal and the pattern formed of each C/A code therefore allows detection of the C/A code superimposed on the satellite signal.

Each of the GPS satellites 20 has an atomic clock incorporated therein, and the satellite signal contains very accurate time information (hereinafter referred to as "GPS time information") having been measured by using the atomic clock. Further, a ground control segment measures a slight time error produced by the atomic clock incorporated in each of the GPS satellites 20. The satellite signal also contains a time correction parameter to correct a time error. The electronic timepiece 100 receives the satellite signal transmitted from one of the GPS satellites 20. The electronic timepiece 100 uses the GPS time information and the time correction parameter contained in the satellite signal to correct the internal time to achieve correct time.

The satellite signal further contains orbit information representing the on-orbit position of the GPS satellite 20. The electronic timepiece 100 can perform positioning calculation by using the GPS time information and the orbit information. The positioning calculation is performed on the precondition that the internal time of the electronic timepiece 100 contains an error to some extent. That is, not only parameters x, y, and z for identifying the three-dimensional position of the electronic timepiece 100 but also the time error are unknown. The electronic timepiece 100 therefore typically receives satellite signals transmitted from at least four GPS satellites and uses the GPS time information and the orbit information contained in the received satellite signals for the positioning calculation.

Figure 2:
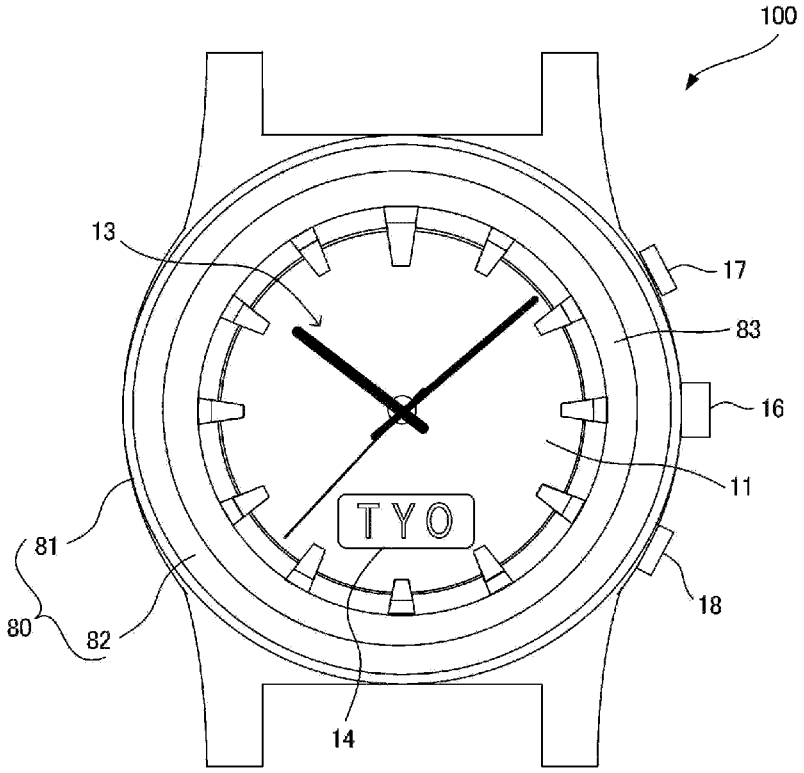
FIG. 2 is a plan view of the electronic timepiece 100.

FIG. 2 is a plan view of the electronic timepiece 100. The electronic timepiece 100 includes a cylindrical exterior case 80 formed of a conductive member made of a metal, as shown in FIG. 2. The electronic timepiece 100 further has a disk-shaped dial 11 as a time display portion disposed inside the exterior case 80 with an annular dial ring 83 made of a plastic material interposed between the dial 11 and the exterior case 80. On the dial 11 are disposed indication hands 13 (13*a* to 13*c*), which indicate time, date, and other types of information. Further, a liquid crystal panel 14 is disposed in a position below the dial 11, and the liquid crystal panel 14 is visible through an opening 11*a* formed through the dial 11. A front-side opening of the exterior case 80 is blocked with a cover glass plate 84. It is, however, noted that the dial 11, the indication hands 13 (13*a* to 13*c*), and the liquid crystal display panel 14 inside the exterior case 80 are visible through the cover glass plate 84. In FIG. 2, the characters "TYO" displayed on the liquid crystal display panel 14 mean "TOKYO," which indicates that a world time function of the timepiece shows Japan time.

In the present embodiment, the exterior case 80 may instead be formed of a nonconductive member made of a ceramic material (zirconia). In this case, antenna performance can be improved. A ceramic material, which is expensive but hard, is unlikely to be scratched. The exterior case 80 is not necessarily made of a ceramic material and may be formed of any nonconductive member, for example, a plastic member. The exterior case 80 may still instead be formed of a combination of a nonconductive member and a conductive member. In this case, a portion of the exterior case 80 in the vicinity of a ring-shaped antenna body 40 (see FIG. 3), which will be described later, is formed of a nonconductive member, and other portions of the exterior case 80 are formed of a conductive member made, for example, of a metal. The configuration described above can reduce the amount of degradation in performance of satellite signal reception.

The electronic timepiece 100 is so configured that the operation mode thereof can be switched between a time information acquisition mode and a position information acquisition mode through manual operation of a crown 16 and operation buttons 17 and 18 shown in FIGS. 1 and 2. In the time information acquisition mode, the electronic timepiece 100 receives a satellite signal from at least one of the GPS satellites 20 for correction of internal time information. In the position information acquisition mode, the electronic timepiece 100 receives satellite signals from a plurality of the GPS satellites 20 for the positioning calculation, followed by correction of time difference between the internal time information and correct time. Further, the electronic timepiece 100 can regularly (automatically) switch the operation mode thereof between the time information acquisition mode and the position information acquisition mode.

Figure 3:
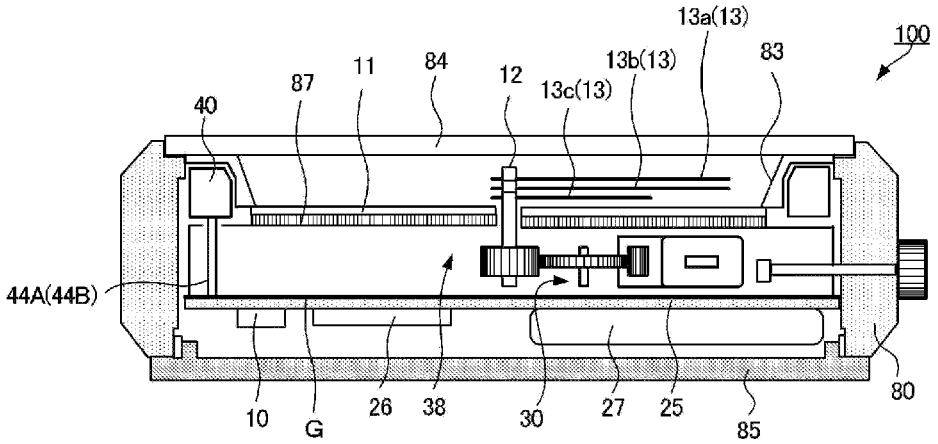
FIG. 3 is a partial cross-sectional view of the electronic timepiece 100 according to a first embodiment.
Figure 4:
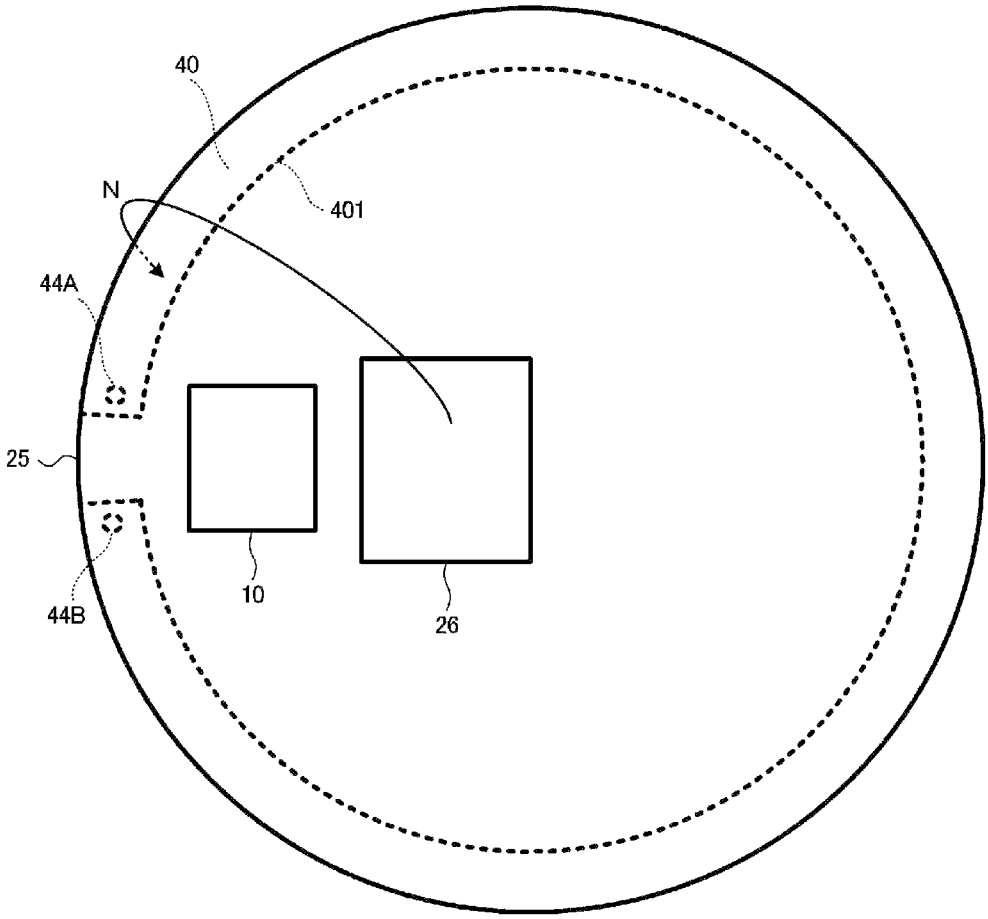
FIG. 4 is a plan view of a circuit substrate 25 viewed from a component implementation surface side.
Figure 5:
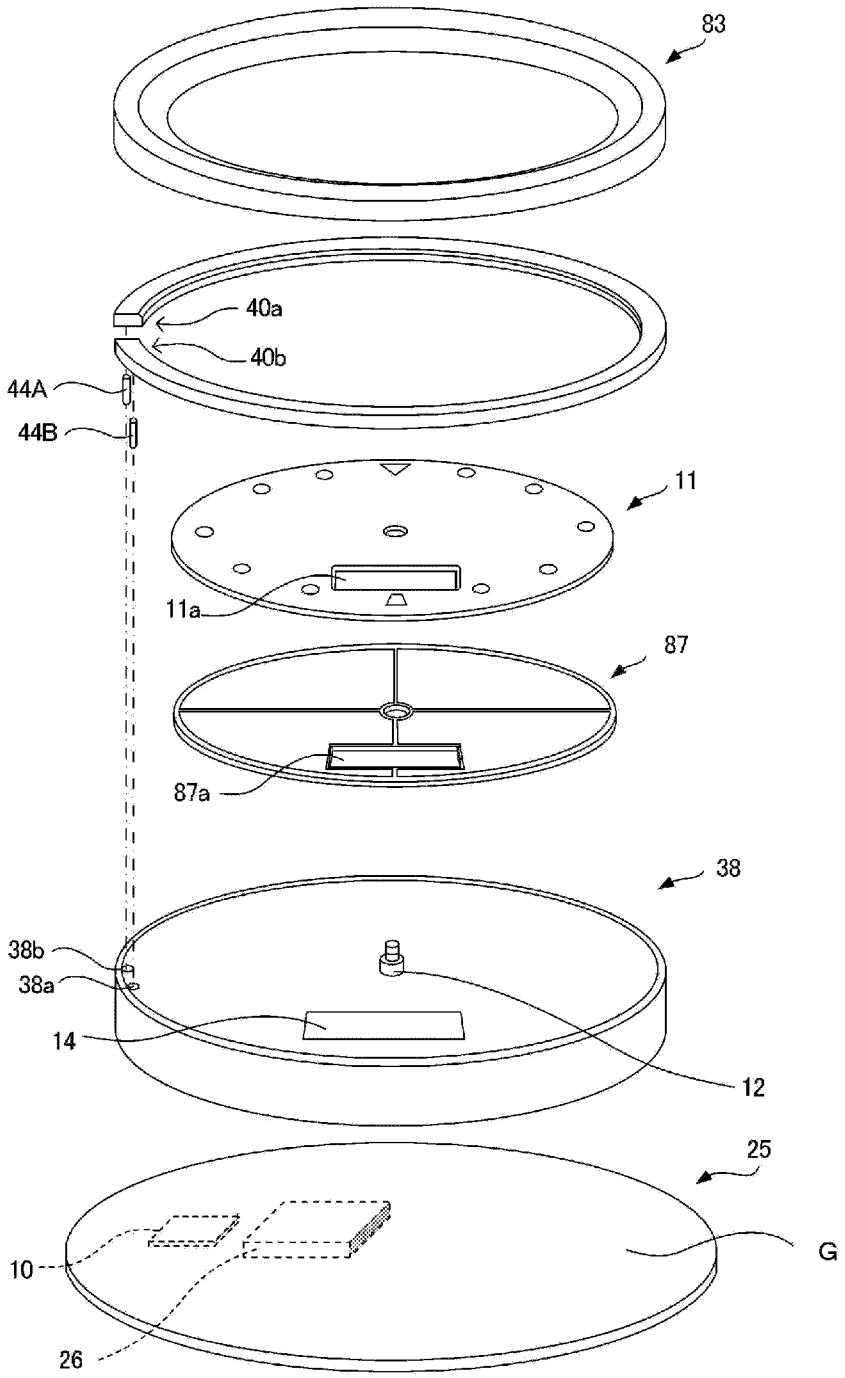
FIG. 5 is an exploded perspective view of part of the electronic timepiece 100 according to the first embodiment.

FIG. 3 is a partial cross-sectional view showing the internal structure of the electronic timepiece 100 according to the first embodiment. FIG. 4 is a plan view of a circuit substrate 25 viewed from the rear side. FIG. 5 is an exploded perspective view of part of the electronic timepiece 100 according to the first embodiment. In the electronic timepiece 100, the annular dial ring 83, which is made of a plastic material, is attached to the front side of the exterior case 80, which is made of a metal, as shown in FIGS. 3 to 5. Further, the ring-shaped antenna body 40 is disposed inside the dial ring 83.

The two openings of the exterior case 80 are blocked as follows: The opening on the front side, which is the side where the time display portion displays time, is blocked with the cover glass plate 84; and the rear-side opening is blocked with a case back 85 made of stainless steel or any other metal.

The cover glass plate 84 is fit into the exterior case 80 with a gasket ring (not shown) interposed between the cover glass plate 84 and the exterior case 80.

The electronic timepiece 100 includes a secondary battery 27, such as a lithium-ion battery, inside the exterior case 80. The secondary battery 27 is charged with electric power generated by a solar panel 87, which will be described later. That is, the secondary battery 27 is charged based on solar energy. The electronic timepiece 100 includes the following components inside the exterior case 80: the dial 11, which is light transmissive; an indication hand shaft 12, which passes through the dial 11; a plurality of indication hands 13 (second hand 13*a*, minute hand 13*b*, and hour hand 13*c*), which go around the indication hand shaft 12 and indicate the current time; and a drive mechanism 30, which rotates the indication hand shaft 12 to drive the plurality of indication hands 13. The indication hand shaft 12 extends frontward and rearward along the central axis of the exterior case 80.

The dial 11 is a circular plate that forms the time display portion, which displays time inside the exterior case 80. The dial 11 is made of a light transmissive material, such as a plastic material, and disposed inside the dial ring 83 with the indication hands 13 (13*a* to 13*c*) interposed between the dial 11 and the cover glass plate 84. A hole through which the indication hand shaft 12 passes and the opening 11*a*, which makes the liquid crystal display panel 14 visible, are formed through a central portion of the dial 11.

The drive mechanism 30 is attached to a main plate 38 and has a stepper motor and wheel trains, such as gears. The stepper motor rotates the indication hands 13 via the wheel trains to drive the plurality of indication hands 13. Specifically, the hour hand 13*c*, the minute hand 13*b*, and the second hand 13*c* make a turn in 12 hours, 60 minutes, and 60 seconds, respectively. The main plate 38, to which the drive mechanism 30 is attached, is so disposed that the main plate 38 and the indication hands 13 sandwich the dial 11. Inside the main plate 38 may be provided a controller 70 and a drive circuit 74, which drives the stepper motor. These components will be described later (see FIG. 6).

The electronic timepiece 100 further includes the solar panel 87, which photo-electrically generates electric power, inside the exterior case 80. The solar panel 87 is a circular flat plate in which a plurality of solar cells (photo-electric, power generating devices), each of which converts optical energy into electric energy (electric power), are serially connected to each other. The solar panel 87 is disposed in a position between the dial 11 and the drive mechanism 30 and extends along a transverse plane of the indication hand shaft 12. Further, in the direction in which the solar panel 87 extends, the solar panel 87 is disposed inside the dial ring 83. Moreover, a hole or cutout through which the indication hand shaft 12 passes and the opening 87*a*, which makes the liquid crystal display panel 14 visible, are formed through a central portion of the solar panel 87.

The electronic timepiece 100 further includes the following components inside the exterior case 80: antenna connection pins 44A and 44B; a circuit substrate 25; and a balun 10 and a GPS receiver (wireless receiver) 26, which are implemented on the circuit substrate 25. The GPS receiver 26 is formed, for example, of a single-chip IC module that includes an analog circuit and a digital circuit. The balun 10 is a balance/unbalance conversion device and converts a balanced signal from the antenna body 40, which operates in a balanced feed mode, into an unbalanced signal that can be handled by the GPS receiver 26. The circuit substrate 25 is made of a material containing a resin or a dielectric and disposed in a position below the main plate 38.

The lower surface of the circuit substrate 25 (surface facing case back 85) is a component implementation surface on which the balun 10 and the GPS receiver 26 are disposed. The surface of the circuit substrate 25 (surface facing cover glass plate 84) that faces away from the component implementation surface has a shield pattern G formed thereon and also functions as a ground plate. When the circuit substrate 25 is formed of a multilayer substrate, the shield pattern G may be formed in an inner layer. The shield pattern G functions as a shield against an electromagnetic wave and an electric field. A ground potential is preferably supplied to the shield pattern G.

The electronic timepiece 100 further includes the ring-shaped antenna body 40, which specifically has an annular shape with part thereof cut off. The antenna body 40 may instead be formed of a plate-shaped metal member made, for example, of stainless steel and may even be combined with a dielectric. The antenna body 40 is disposed inside the exterior case 80 and around the drive mechanism 30 in the present embodiment. That is, the antenna body 40 is disposed in a position closer to the cover glass plate 84 than the circuit substrate 25.

Electric power is fed to the antenna body 40 via both ends of the antenna body 40, that is, a pair of feed points 40*a* and 40*b* located on opposite sides with the cutout of the C-like shape interposed. The feed points 40*a* and 40*b* are connected to the antenna connection pins 44A and 44B, respectively, which are disposed on the lower surface of the antenna. The antenna connection pins 44A and 44B form a pin-shaped connector made of a metal and each have a built-in spring. The antenna connection pins 44A and 44B protrude from the circuit substrate 25, pass through insertion holes 38*a* and 38*b* open through the main plate 38, and connect the circuit substrate 25 and the antenna body 40 to each other.

In the present embodiment, electric power is fed to the antenna body 40 from the balun 10 through the two feed points 40*a* and 40*b* in a balanced feed mode. Specifically, the feed points 40*a* and 40*b*, which have positive and negative signs respectively, are formed at opposite ends of the antenna body 40. The two feed points 40*a* and 40*b* are connected to the antenna connection pins 44A and 44B, respectively. The balanced feed mode is achieved via the antenna connection pins 44A and 44B. The GPS receiver 26 uses the thus fed antenna body 40 to receive a wireless signal. The antenna body 40, which is a single-wavelength loop antenna, is self-balanced when power is fed thereto. Electric power can therefore instead be directly fed to the antenna body 40 without going through the balun 10 described above.

In the present embodiment, the reason why the ring-shaped antenna body 40 is employed is as follows: Employing a patch antenna and disposing the patch antenna on one side of the circuit substrate as in the electronic timepiece of the related art undesirably creates an unused space above the one side of the circuit substrate. A circuit module needs to be disposed in the unused space from a viewpoint of compactness of the timepiece. Disposing the circuit module in the unused space, however, undesirably causes noise to be inputted to the patch antenna from the circuit module. To prevent noise from being inputted to the patch antenna, the circuit module needs to be shielded. A shielded structure, however, undesirably occupies a certain amount of space, results in a complicated structure, and causes an increase in cost. In view of the facts described above, in the present embodiment, the ring-shaped antenna body 40 is disposed along the inner circumference of the case 80, allowing the indication hands 13 and other components, which forma non-circuit structure, to be disposed in a central portion of the case 80, whereby space usage efficiency is improved. In addition, the shield pattern G is formed on the circuit substrate 25. With the shield pattern G as a boundary, the antenna body 40 is disposed on one side, and the balun 10 and the GPS receiver 26 are disposed on the other side. That is, no analog circuit that amplifies a signal or no digital circuit that processes the amplified signal is disposed on the side where the antenna body 40 is disposed. The configuration prevents noise produced by the GPS receiver 26 from being inputted to the antenna body 40.

The thus configured present embodiment can improve space usage efficiency and greatly reduce the amount of noise inputted to the antenna body 40.

The balun 10 in this example is disposed inside the inner circumference 401 of the antenna body 40, and the GPS receiver 26 is disposed in a more inner position than the balun 10, as shown in FIG. 4. Since the shield pattern G is formed on the circuit substrate 25, noise N radiated from the GPS receiver 26 detours around the outer circumference of the circuit substrate 25 and reaches the ring-shaped antenna body 40. The magnitude of the noise N inputted to the ring-shaped antenna body 40 decreases with distance from the GPS receiver 26, which is a noise source. In the present embodiment, since the GPS receiver 26 is disposed in a more inner position than the balun 10, the amount of noise N inputted to the ring-shaped antenna body 40 can be greatly reduced. The balun 10 may instead be disposed in a position immediately below the antenna connection pins 44A and 44B. In this case as well, the GPS receiver 26 is preferably disposed inside the inner circumference 401 of the antenna body 40.

Figure 6:
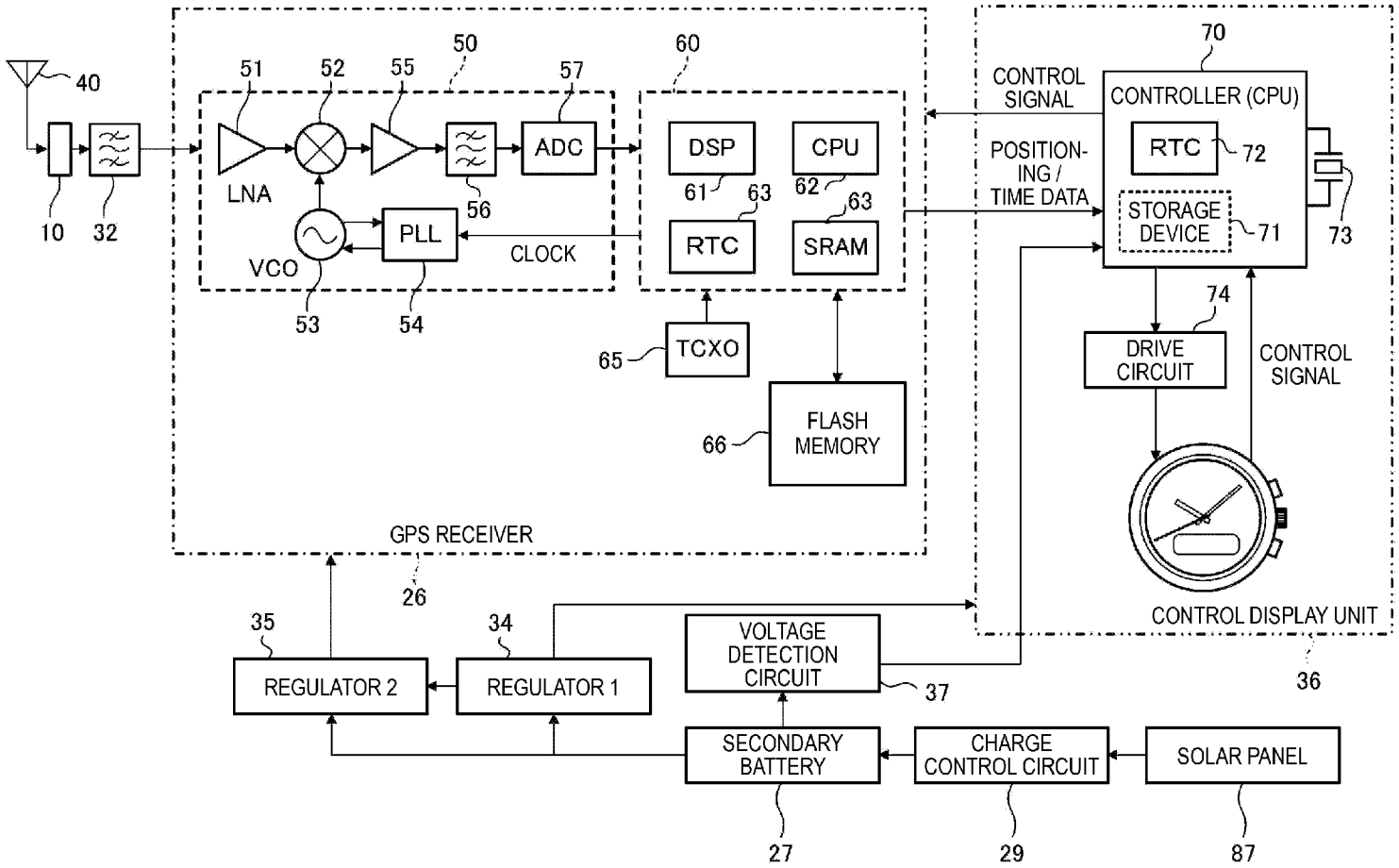
FIG. 6 is a block diagram showing the circuit configuration of the electronic timepiece 100.

FIG. 6 is a block diagram showing the circuit configuration of the electronic timepiece 100. The electronic timepiece 100 includes the GPS receiver 26 and a control display unit 36, as shown in FIG. 6. The GPS receiver 26 receives a satellite signal, locates the corresponding GPS satellite 20, produces position information, produces time correction information, and carries out other processes. The control display unit 36 holds the internal time information, corrects the internal time information, and carries out other processes.

The solar panel 87 charges the secondary battery 27 via a charge control circuit 29. The electronic timepiece 100 includes regulators 34 and 35, and the secondary battery 27 supplies the control display unit 36 with drive electric power via the regulator 34 and the GPS receiver 26 with drive electric power via the regulator 35. The electronic timepiece 100 further includes a voltage detection circuit 37, which detects the voltage across the secondary batter 27. The regulator 35 may be replaced, for example, with the following two regulators: a regulator 35-1, which supplies an RF section 50 (which will be described later in detail) with drive electric power, and a regulator 35-2, which supplies a baseband section 60 (which will be described later in detail) with drive electric power (neither regulator 35-1 nor 35-2 is shown). The regulator 35-1 may be disposed in the RF portion 50.

The electronic timepiece 100 further includes the antenna body 40, the balun 10, and an SAW (surface acoustic wave) filter 32. The antenna body 40 receives satellite signals from a plurality of the GPS satellites 20, as described with reference to FIG. 1. The antenna body 40, however, receives a small amount of unnecessary electromagnetic wave other than the satellite signals. The SAW filter 32 therefore extracts the satellite signals from the signals received by the antenna body 40. That is, the SAW filter 32 is configured as a bandpass filter that allows a 1.5-GHz-band signal to pass therethrough. The SAW filter 32 may be disposed between the balun 10 and the GPS receiver 26 in FIGS. 3 and 4.

The GPS receiver 26 includes the RF (radio frequency) section 50 and the baseband section 60. As will be described below, the GPS receiver 26 acquires satellite information, such as the orbit information and the GPS time information, which are contained in a navigation message, from the 1.5-GHz-band satellite signal extracted by the SAW filter 32.

The RF section 50 includes an LNA (low noise amplifier) 51, a mixer 52, a VCO (voltage controlled oscillator) 53, a PLL (phase locked loop) circuit 54, an IF amplifier 55, an IF (intermediate frequency) filter 56, and an ADC (A/D converter) 57.

The satellite signal extracted by the SAW filter 32 is amplified by the LNA 51. The satellite signal amplified by the LNA 51 is mixed by the mixer 52 with a clock signal outputted from the VCO 53 into a down-converted signal of an intermediate frequency band. The PLL circuit 54 compares a divided clock signal derived from a clock signal outputted from the VCO 53 with a reference clock signal in terms of phase to synchronize the clock signal outputted from the VCO 53 with the reference clock signal. As a result, the VCO 53 can output a stable-frequency clock signal as precise as the reference clock signal. The intermediate frequency can, for example, be several MHz.

The mixture signal from the mixer 52 is amplified by the IF amplifier 55. At this point, the mixing performed by the mixer 52 produces not only the intermediate-frequency-band signal but also a high-frequency signal of several GHz. The IF amplifier 55 therefore amplifies not only the intermediate-frequency-band signal but also the high-frequency signal of several GHz. The IF filter 56 allows the intermediate-frequency-band signal to pass therethrough but removes the high-frequency signal of several GHz. To be precise, the IF filter 56 attenuates the level of the high-frequency signal to a predetermined level or lower. The intermediate-frequency-band signal having passed through the IF filter 56 is converted by the ADC (A/D converter) 57 into a digital signal.

The baseband section 60 includes a DSP (digital signal processor) 61, a CPU (central processing unit) 62, an SRAM (static random access memory) 63, and an RTC (real time clock) 64. A temperature compensated crystal oscillator (TCXO) 65, a flash memory 66, and other components are connected to the baseband section 60.

The temperature compensated crystal oscillator (TCXO) 65 produces the reference clock signal, which has a substantially fixed frequency irrespective of temperature. The flash memory 66 stores, for example, time difference information. The time difference information is information in which time difference data is defined. The time difference data contains, for example, the amount of correction made with respect to UTC and related to coordinates, such as the latitude and longitude.

When the time information acquisition mode or the position information acquisition mode is set, the baseband section 60 performs demodulation to extract a baseband signal from the converted digital signal (intermediate-frequency-band signal) outputted from the ADC 57 in the RF section 50.

Further, when the time information acquisition mode or the position information acquisition mode is set, the baseband section 60 produces a local code having the same pattern as that of each C/A code in a satellite search step, which will be described later. The baseband section 60 further examines correlation between the C/A code contained in the baseband signal and the local code. The baseband section 60 then adjusts the timing at which the local code is produced in such a way that the degree of the correlation between the C/A code and the local code peaks. When the degree of the correlation is greater than or equal to a threshold, the baseband section 60 determines that the electronic timepiece 100 has been synchronized with the GPS satellite 20 associated with the local code (that is, the GPS satellite 20 has been located). It is noted that the GPS system employs a CDMA (code division multiple access) scheme, in which the GPS satellites 20 use different C/A codes to transmit satellite signals of the same frequency. Identification of the C/A code contained in a received satellite signal allows search for a locatable GPS satellite 20.

To acquire the satellite information on a located GPS satellite 20 in the time information acquisition mode or the position information acquisition mode, the baseband section 60 mixes a local code having the same pattern as that of the C/A code associated with the GPS satellite 20 with the baseband signal. The mixture signal has a demodulated navigation message containing the satellite information on the located GPS satellite 20. The baseband section 60 then detects a TLM word (preamble data) in each sub-frame of the navigation message and acquires the satellite information, such as the orbit information and the GPS time information, contained in the sub-frame (and stores the satellite information, for example, in the SRAM 63). The GPS time information, which is formed of week number data (WN) and Z count data, may be formed only of the Z count data when the week number data has already been acquired.

The baseband section 60 then produces, based on the satellite information, time correction information necessary for correction of the internal time information.

In the time information acquisition mode, more specifically, the baseband section 60 performs timing calculation based on the GPS time information to produce the time correction information. The time correction information in the time information acquisition mode may, for example, be the GPS time information itself or information on time difference between the GPS time information and the internal time information.

On the other hand, in the position information acquisition mode, more specifically, the baseband section 60 performs the positioning calculation based on the GPS time information and the orbit information to produce position information. Still more specifically, the baseband section 60 acquires the latitude and longitude of the location of the electronic timepiece 100 at the time of satellite signal reception. The baseband section 60 further refers to the time difference information stored in the flash memory 66 and acquires time difference data related to the coordinates (latitude and longitude, for example) of the electronic timepiece 100 that are identified by the position information. The baseband section 60 thus produces satellite time data (GPS time information) and the time difference data as the time correction information. The time correction information in the position information acquisition mode may be the GPS time information and the time difference data themselves as described above or may, for example, be data on the time difference between the internal time information and the GPS time information instead of the GPS time information.

The baseband section 60 may produce the time correction information from the satellite information on one of the GPS satellites 20 or may produce the time correction information from satellite information on a plurality of the GPS satellites 20.

The action of the baseband section 60 is synchronized with the reference clock signal outputted from the temperature compensated crystal oscillator (TCXO) 65. The RTC 64 produces timing at which a satellite signal is processed. The RTC 64 is incremented in response to the reference clock signal outputted from the TCXO 65. The RTC 64 provided in the baseband section 60 operates only when satellite information on a GPS satellite 20 is being received and holds the GPS time information.

The control display unit 36 includes a controller 70, a drive circuit 74, and a crystal oscillator 73.

The controller 70 includes a storage device 71 and an RTC (real time clock) 72 and performs a variety of types of control. The controller 70 can be formed, for example, of a CPU. The controller 70 sends a control signal to the GPS receiver 26 to control signal reception action of the GPS receiver 26. The controller 70 further controls the action of the regulators 34 and 35 based on a detection result from the voltage detection circuit 37. The controller 70 further controls drive operation of all the indication hands via the drive circuit 74.

The storage device 71 stores the internal time information. The RTC 72, which always operates, measures the internal time for time display operation and produces the internal time information. The internal time information is information on time measured inside the electronic timepiece 100 and updated based on a reference clock signal produced by the crystal oscillator 73. Therefore, even when electric power supplied to the GPS receiver 26 is terminated, the internal time information can be updated to keep the indication hands moving.

When the time information acquisition mode is set, the controller 70 controls the action of the GPS receiver 26 to correct the internal time information based on the GPS time information and stores the corrected internal time information in the storage device 71. More specifically, the internal time information is corrected to UTC (coordinated universal time) calculated by adding a UTC offset to the acquired GPS time information. When the position information acquisition mode is set, the controller 70 controls the action of the GPS receiver 26 to correct the internal time information based on the satellite time data (GPS time information) and the time difference data and stores the corrected internal time information in the storage device 71.

As described above, the electronic timepiece 100 according to the first embodiment, in which the ring-shaped antenna body 40 is disposed along the inner circumference of the case 80 and the indication hands 13 and other components that form a non-circuit structure can be disposed in a central portion of the case 80, achieves improved space usage efficiency. Further, with the shield pattern Gas the boundary, the balun 10 and the GPS receiver 26 are disposed on the side facing away from the antenna body 40, and no analog circuit that amplifies a signal or no digital circuit that processes the amplified signal is disposed on the side where the antenna body 40 is disposed. As a result, noise produced by the GPS receiver 26 is not inputted to the antenna body 40, whereby the amount of noise inputted to the antenna body 40 can be greatly reduced. The electronic timepiece 100 can therefore achieve improved space usage efficiency and improved signal reception performance at the same time.

Figure 7:
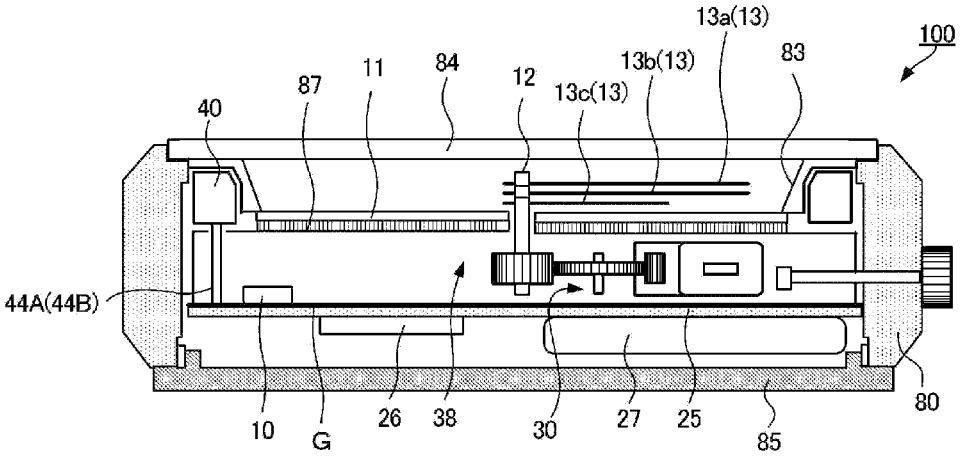
FIG. 7 is a partial cross-sectional view of the electronic timepiece 100 according to a variation of the first embodiment.

In the first embodiment described above, with the shield pattern G as the boundary, the ring-shaped antenna body 40 is disposed on one side, and the balun 10 and the GPS receiver 26 are disposed on the other side or on the component implementation surface of the circuit substrate 25, but the invention is not necessarily configured this way. The balun 10 may instead be so disposed on the circuit substrate 25 that the balun 10 faces the antenna body 40, and the GPS receiver 26 may be so disposed on the component implementation surface of the circuit substrate 25 that the GPS receiver 26 faces away from the ring-shaped antenna body 40, as shown in FIG. 7. This configuration prevents noise from the GPS receiver 26 from being inputted to the balun 10. In this case as well, it is preferable from a viewpoint of preventing noise from the GPS receiver 26 from being inputted to the ring-shaped antenna body 40 that the balun 10 is disposed inside the inner circumference of the antenna body 40 and the GPS receiver 26 is disposed in a position closer to the center of the ring-shaped antenna body 40 than the balun 10. In the configuration described above, the shield pattern G, when it is formed on the front side of the circuit substrate 25, is not formed on an area where wiring lines from the antenna connection pins 44A and 44B to the balun 10 and the balun 10 itself are disposed. The SAW filter 32 may be disposed in a position between the balun 10 and the GPS receiver 26.

Second Embodiment

A second embodiment of the invention will next be described.

An electronic timepiece 100 according to the second embodiment is so configured that an urging member attached to the main plate 38 is allowed to engage with an engaging portion of the antenna body 40 and the urging member urges the antenna body 40 toward a reference plane to form a predetermined gap G1 between the antenna body 40 and a structure above the antennal body 40. In the second embodiment, the description will be primarily made of how to attach the urging member to the main plate 38 and allow the urging member to engage with the antenna body 40 so that the antenna body 40 is fixed to the main plate 38 in the first place. The second embodiment is the same as the first embodiment except the configuration described above, and the portions common to those in the first embodiment will not therefore be described.

Figure 8:
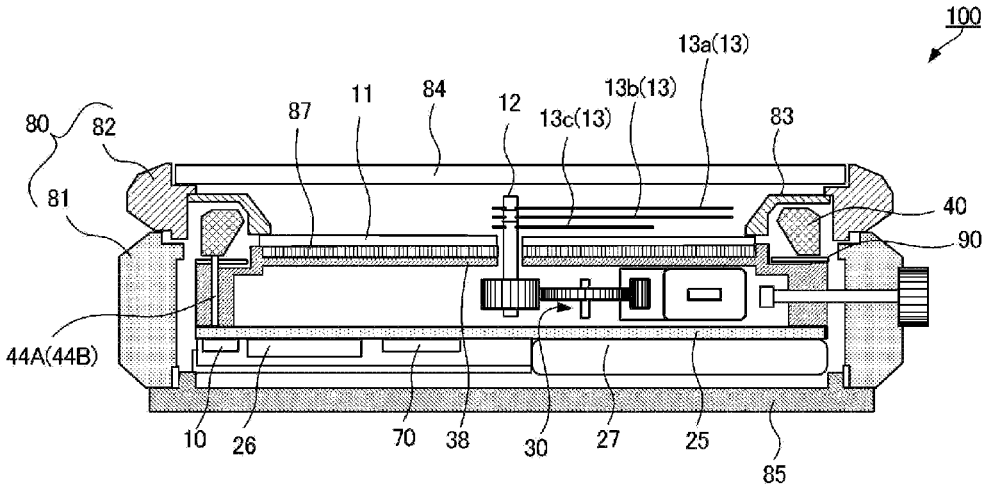
FIG. 8 is a partial cross-sectional view of an electronic timepiece 100 according to a second embodiment.
Figure 9:
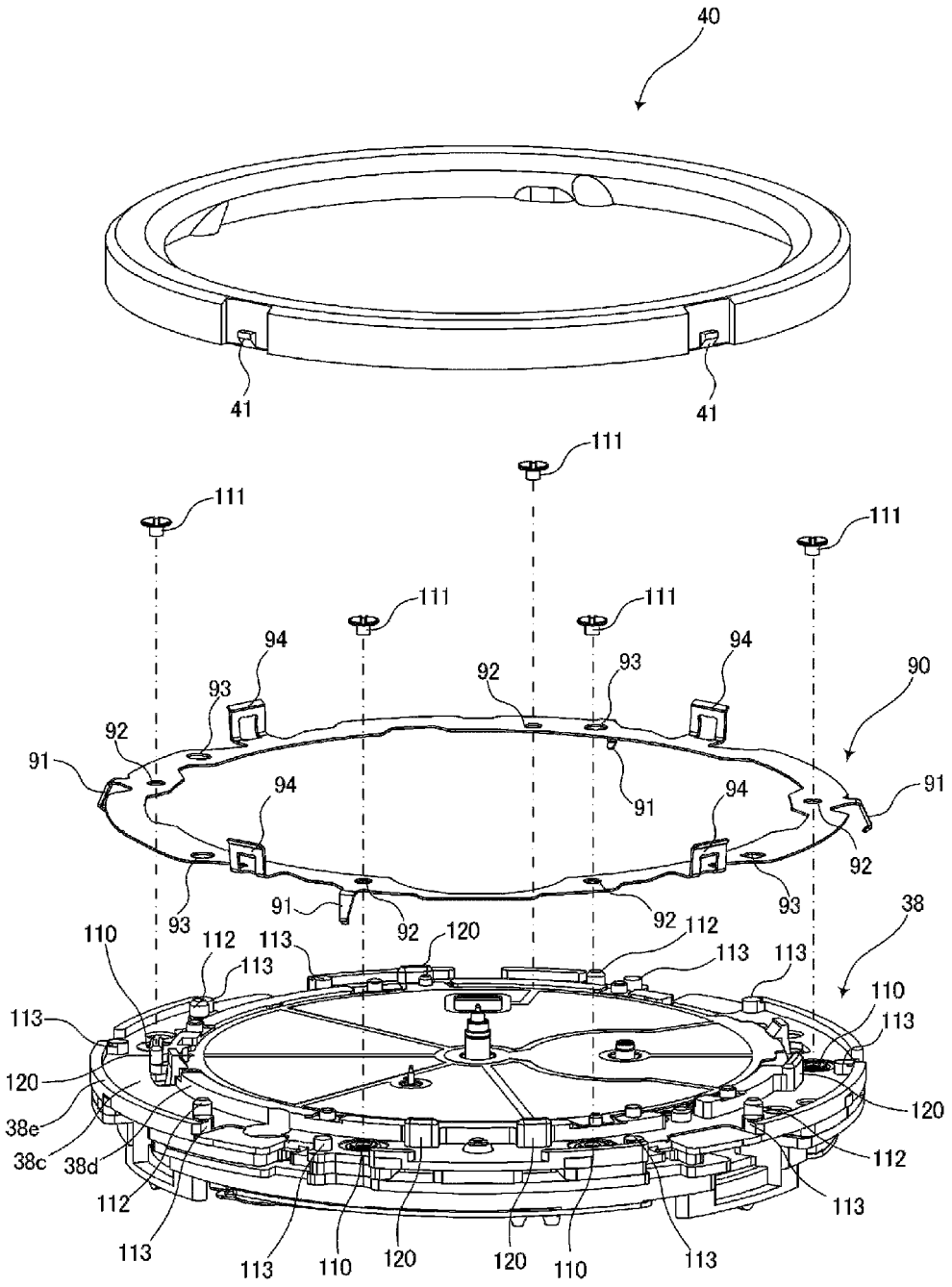
FIG. 9 is an exploded perspective view of part of the electronic timepiece 100 according to the second embodiment.

FIG. 8 is a partial cross-sectional view showing the internal configuration of the electronic timepiece 100 according to the second embodiment, and FIG. 9 is an exploded perspective view of part of the electronic timepiece 100 according to the second embodiment. In the electronic timepiece 100, a glass frame 82 made of a ceramic material is fit in a cylindrical case 81 made of a metal, as shown in FIG. 8. The ring-shaped dial ring 83 made of a plastic material is attached to the electronic timepiece 100 along the inner circumference of the glass frame 82.

Since the antenna body 40 is set in a position below the cover glass plate 84, satisfactory signal reception is ensured. Further, since the portion above the antenna body 40 is covered with the dial ring 83, the antenna body 40 is not exposed to the atmosphere. Moreover, since the dial ring 83 can be decorated as part of the exterior appearance, the exterior appearance can still be freely designed. Since the antenna body 40 is positioned outside the dial 11, the exterior appearance of the dial 11 can also still be freely designed.

How to attach the antenna body 40 will next be described. In the present embodiment, the main plate 38 has an antenna body accommodation portion 38*c* surrounded by an inner circumferential sidewall 38*d* and an outer circumferential sidewall 38*e*, as shown in FIG. 9. A ring-shaped fixing plate 90, which is made of a metal and serves as the urging member, is attached to the accommodation portion 38*c*, and the fixing plate 90 and the antenna body 40 are allowed to engage with each other. The antenna body 40 is thus fixed to the main plate 38.

The main plate 38 has antenna guide protrusions 112, which are formed at four locations and serve as first guide engaging portions extending in the vertical direction. The fixing plate 90 has a plurality of insertion holes 93 formed therein, through which the antenna guide protrusions 112 are inserted. The fixing plate 90 is positioned in the planar direction and the circumferential direction of the main plate 38 when the antenna guide protrusions 112 are inserted through the insertion holes 93.

Further, the fixing plate 90 has conduction portions 91 formed at four locations along the outer circumference, as shown in FIG. 9, and the conduction portions 91 are so configured that they come into contact with the inner surface of the exterior case 80.

Five screws 111 are then inserted through a plurality of insertion holes 92 formed in the fixing plate 90 and allowed to engage with threaded holes 110 formed in the main plate 38 at five locations. The fixing plate 90 is thus securely fixed to the main plate 38.

As described above, in the present embodiment, the fixing plate 90 is not attached to the main plate 38 with the entire fixing plate 90 being in intimate contact with the accommodation portion 38*c*, but the fixing plate 90 is attached to the main plate 38 with the plurality of screws 111 with part of the fixing plate 90 being in intimate contact with the main plate 38.

A lower portion of the antenna body 40 has recesses that serve as second guide engaging portions and engage with the antenna guide protrusions 112 described above. When the antenna guide protrusions 112 of the main plate 38 are fit into the recesses of the antenna body 40, the antenna body 40 is positioned in the planar direction and the circumferential direction of the main plate 38.

Instead, the first engaging portions formed in the main plate may be recesses, and the second engaging portions formed on the antenna body may be protrusions.

Further, the fixing plate 90 has hooks 94 at four locations, and the antenna body 40 has overhung protrusions 41, which serve as engaging portions that engage with the hooks 94. The main plate 38 has seat portions 113, which are formed at a plurality of locations and serve as a reference surface for determining the vertical position of the antenna body 40.

After the fixing plate 90 is attached to the main plate 38, the antenna body 40 is so attached that the antenna guide protrusions 112 of the main plate 38 engage with the recesses of the antenna body 40. The antenna body 40 thus comes into contact with the seat portions 113 at the plurality of locations. Further, when the hooks 94 of the fixing plate 90 are allowed to engage with the overhung protrusions 41 formed on the antenna body 40, the antenna body 40 is urged toward the main plate 38 by an elastic force produced by the fixing plate 90. As a result, the antenna body 40 is pressed against the seat portions 113. The antenna body 40 is thus reliably positioned in the direction perpendicular to the main plate 38.

The positions where the hooks 94 engage with the protrusions 41 and the positions where the fixing plate 90 is attached to the main plate 38 with the screws 111 are so set that the two types of positions are kept apart by a predetermined gap in the circumferential direction of the main plate 38, as shown in FIG. 9. The thus set positions allow the fixing plate 90 to produce an elastic force, which allows the antenna body 40 to return to its original position even when the antenna body 40 is displaced due, for example, to vibration. The details will be described later.

Further, in the present embodiment, main plate perpendicular surface portions 120 are formed at a plurality of positions of the main plate 38 in the circumferential direction thereof, specifically, at five locations, as shown in FIG. 9. Each of the main plate perpendicular surface portions 120 has a surface perpendicular to the surface of the main plate 38 and facing a corresponding antenna perpendicular surface formed as part of the inner circumferential surface of the antenna body 40. The details will be described later.

Antenna Body Breakage Prevention Mechanism of Electronic Timepiece with Built-in Antenna A breakage prevention mechanism that is provided in the electronic timepiece 100 according to the present embodiment and prevents the antenna body 40 from being broken will next be described in detail.

The electronic timepiece 100 according to the present embodiment includes the main plate 38, the ring-shaped fixing plate 90 made of a metal, and the antenna body 40, as shown in FIG. 9. The fixing plate 90 has the conduction portions 91 extending downward from the fixing plate 90 at four locations along the outer circumference thereof.

The main plate 38 has the antenna body accommodation portion 38*c* formed therein and surrounded by the inner circumferential sidewall 38*d* and the outer circumferential sidewall 38*e*. To attach the fixing plate 90 to the main plate 38, the antenna guide protrusions 112 formed on the main plate 38 are first inserted through the insertion holes 93 of the fixing plate 90 to place the fixing plate 90 in the accommodation portion 38*c*. With the antenna guide protrusions 112 inserted through the insertion holes 93, the fixing plate 90 is positioned in the planar direction and the circumferential direction of the main plate 38. The conduction portions 91 come into contact with the inner surface of the exterior case 80 so that the fixing plate 90 is electrically connected to the exterior case 80 made of a metal.

The main plate 38 has the threaded holes 110 formed at five locations, and the fixing plate 90 has the insertion holes 92 formed in the positions corresponding to the threaded holes 110. The fixing plate 90 is temporarily fixed to the main plate 38 by positioning them in such a way that the insertion holes 92 of the fixing plate 90 coincide with the threaded holes 110 of the main plate 38. The plurality of screws 111 are then allowed to engage with the threaded holes 110 to securely fix the fixing plate 90 to the main plate 38.

Figure 10:
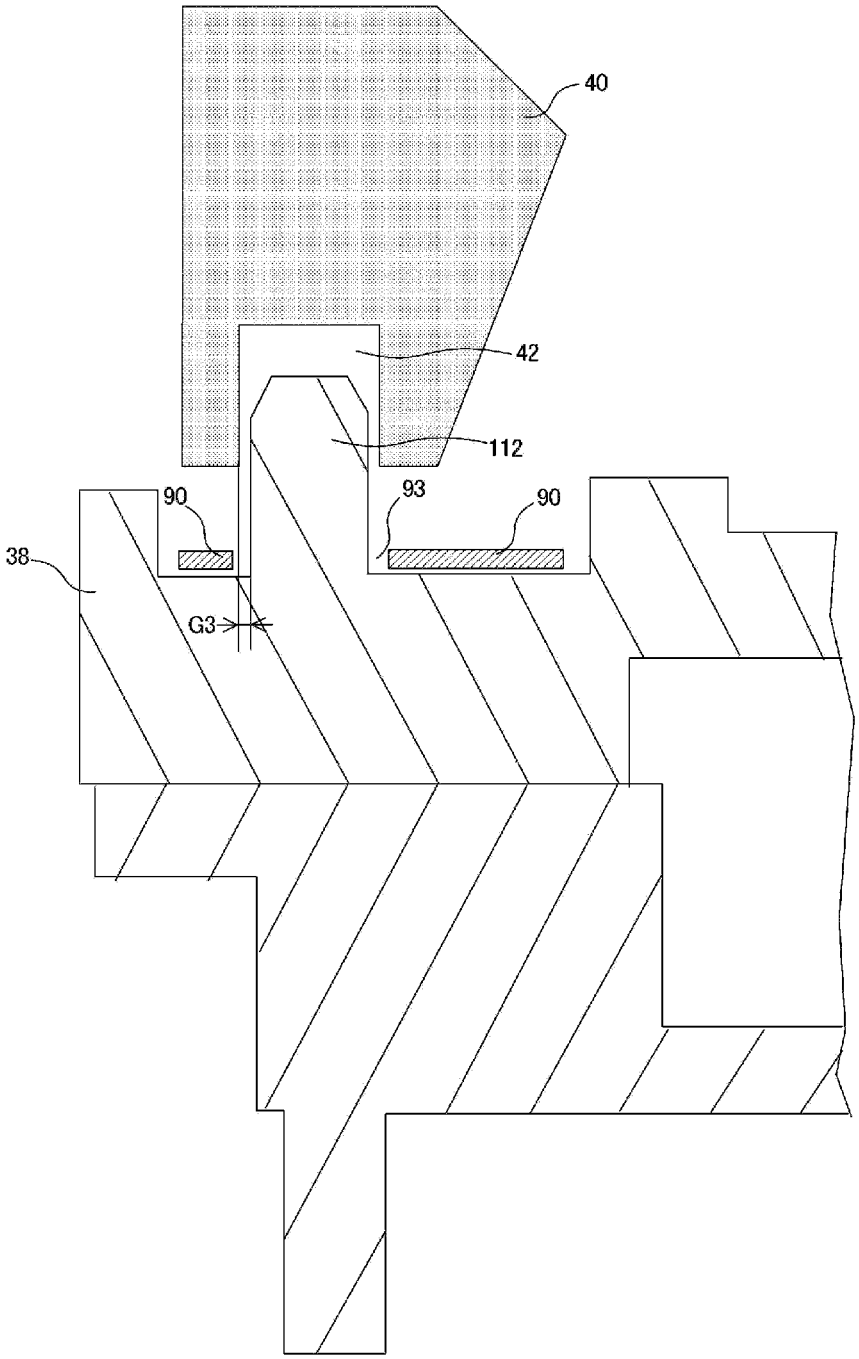
FIG. 10 is a partially cutaway cross-sectional view showing a state in which a ring antenna engages with a protrusion formed on a main plate in the electronic timepiece 100.

With the fixing plate 90 attached to the main plate 38, the antenna guide protrusions 112 protrude from the fixing plate 90 through the insertion holes 93 in the direction perpendicular to the surface of the main plate 38, as shown in FIG. 10.

A lower portion of the antenna body 40 has the recesses 42 formed therein, which engage with the antenna guide protrusions 112, as shown in FIG. 10. The antenna body 40 is attached to the main plate 38 in such a way that the antenna guide protrusions 112 formed on the main plate 38 are allowed to engage with the recesses 42 of the antenna body 40.

Each of the antenna guide protrusions 112 has a cylindrically columnar shape, and the corresponding recess 42 of the antenna body 40 has a cylindrical shape, as shown in FIG. 9. Therefore, when the antenna guide protrusions 112 of the main plate 38 are fit into the recesses 42 of the antenna body 40, the antenna body 40 is positioned in the planar direction of the main plate 38, and the center of the main plate 38 coincides with the imaginary center of the antenna body 40.

Further, when the antenna guide protrusions 112 are fit into the recesses 42, the antenna body 40 is also positioned in the circumferential direction of the main plate 38. The antenna body 40 is thus positioned in the planar direction and the circumferential direction of the main plate 38.

The fixing plate 90 has the hooks 94, which are formed at four locations and extend upward from the fixing plate 90. Each of the hooks 94 has a through hole 95 formed therein, as shown in FIG. 11(B). Further, the antenna body 40 has the overhung protrusions 41 in the positions corresponding to the hooks 94, as shown in FIG. 11(A).

Further, the main plate 38 has the seat portions 113, which are formed at a plurality of locations and serve as the reference plane for the vertical position of the antenna body 40 with respect to the main plate 38, as shown in FIG. 9. Each of the seat portions 113 has a substantially cylindrically columnar shape, and the upper surface thereof is formed in parallel to the surface of the main plate 38. Further, the seat portions 113 are formed to be flush with the surface of the main plate 38.

Figure 11A:
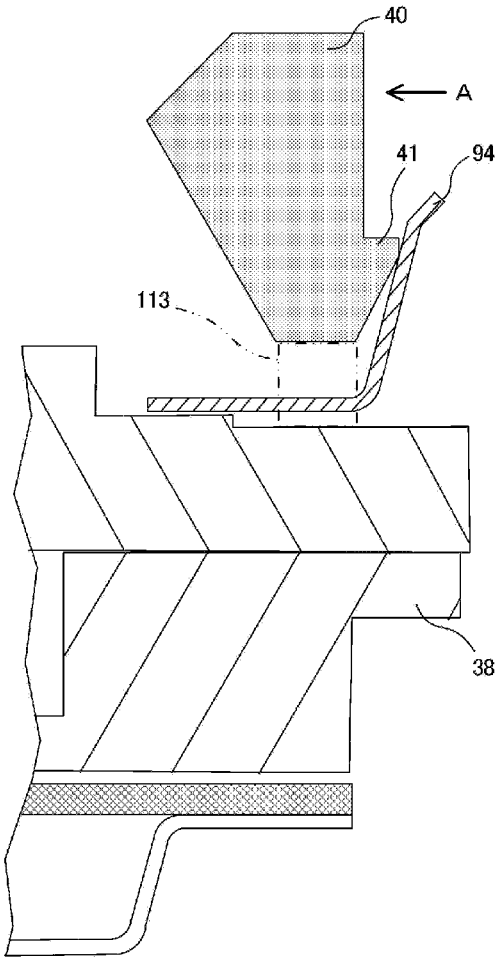
FIG. 11 is a partially cutaway cross-sectional view showing a portion that positions the ring antenna in the vertical direction in the electronic timepiece 100.
Figure 11B:
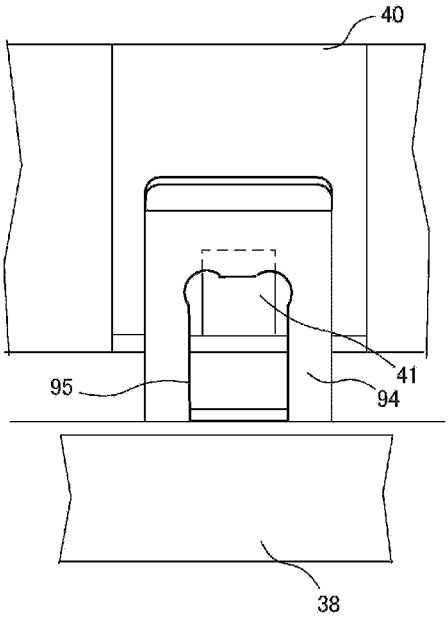

Therefore, after the fixing plate 90 is attached to the main plate 38, and the antenna body 40 is then so attached that the antenna guide protrusions 112 of the main plate 38 engage with the recesses 42 of the antenna body 40, the lower surface of the antenna body 40 comes into contact with the upper surfaces of the seat portions 113 at the plurality of locations, as shown in FIG. 11(A).

FIG. 11(A) shows cross sections of the antenna body 40, the hooks 94 of the fixing plate 90, and the main plate 38, and FIG. 11(B) shows them viewed in the direction indicated by the arrow A shown in FIG. 11(A). In a state in which the antenna body 40 is placed on the seat portions 113, the through holes 95 of the hooks 94 do not engage yet with the overhung protrusions 41 of the antenna body 40, as shown in FIGS. 11(A) and 11(B).

Figure 12A:
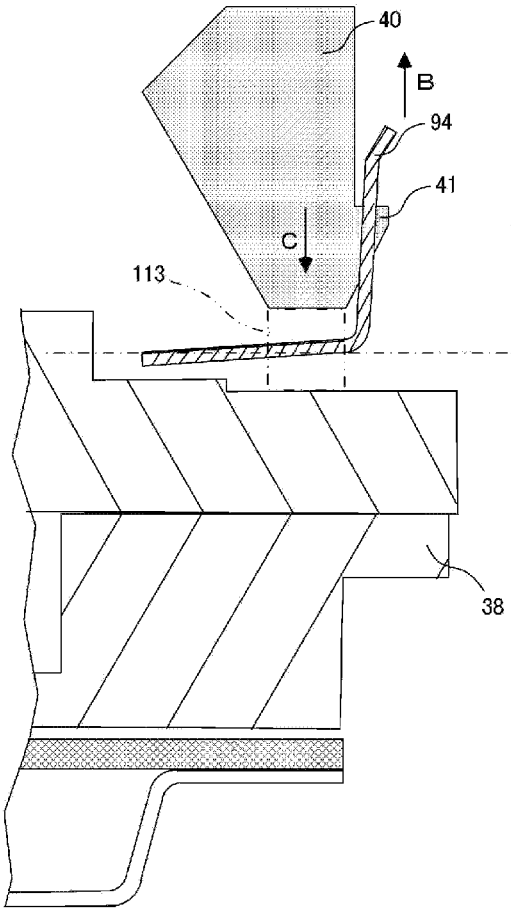
FIG. 12 is another partially cutaway cross-sectional view showing the portion that positions the ring antenna in the vertical direction in the electronic timepiece 100.
Figure 12B:
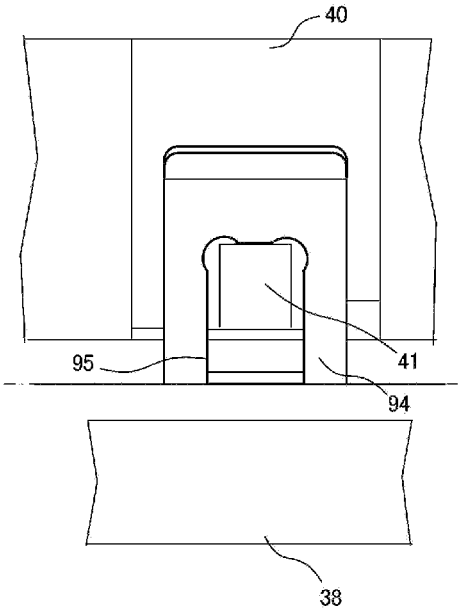

From this state, the hooks 94 are lifted upward, that is, in the direction indicated by the arrow B shown in FIG. 12(A), so that upper portions of the through holes 95 of the hooks 94 are allowed to engage with the overhung protrusions 41 of the antenna body 40, as shown in FIG. 12(A). As a result, the state described above is changed to a state in which the overhung protrusions 41 protrude through the through holes 95 of the hooks 94, as shown in FIG. 12(B).

Since the fixing plate 90 is made of a metal capable of producing an elastic force and fixed to the main plate 38 with the screws 111 as described above, lifting the hooks 94 in the direction indicated by the arrow B shown in FIG. 12(A) causes the antenna body 40 having engaged with the hooks 94 to be urged toward the main plate 38, that is, in the direction indicated by the arrow C shown in FIG. 12(A) and pressed against the seat portions 113.

The antenna body 40 is thus reliably positioned in the direction perpendicular to the surface of the main plate 38.

Figure 13:
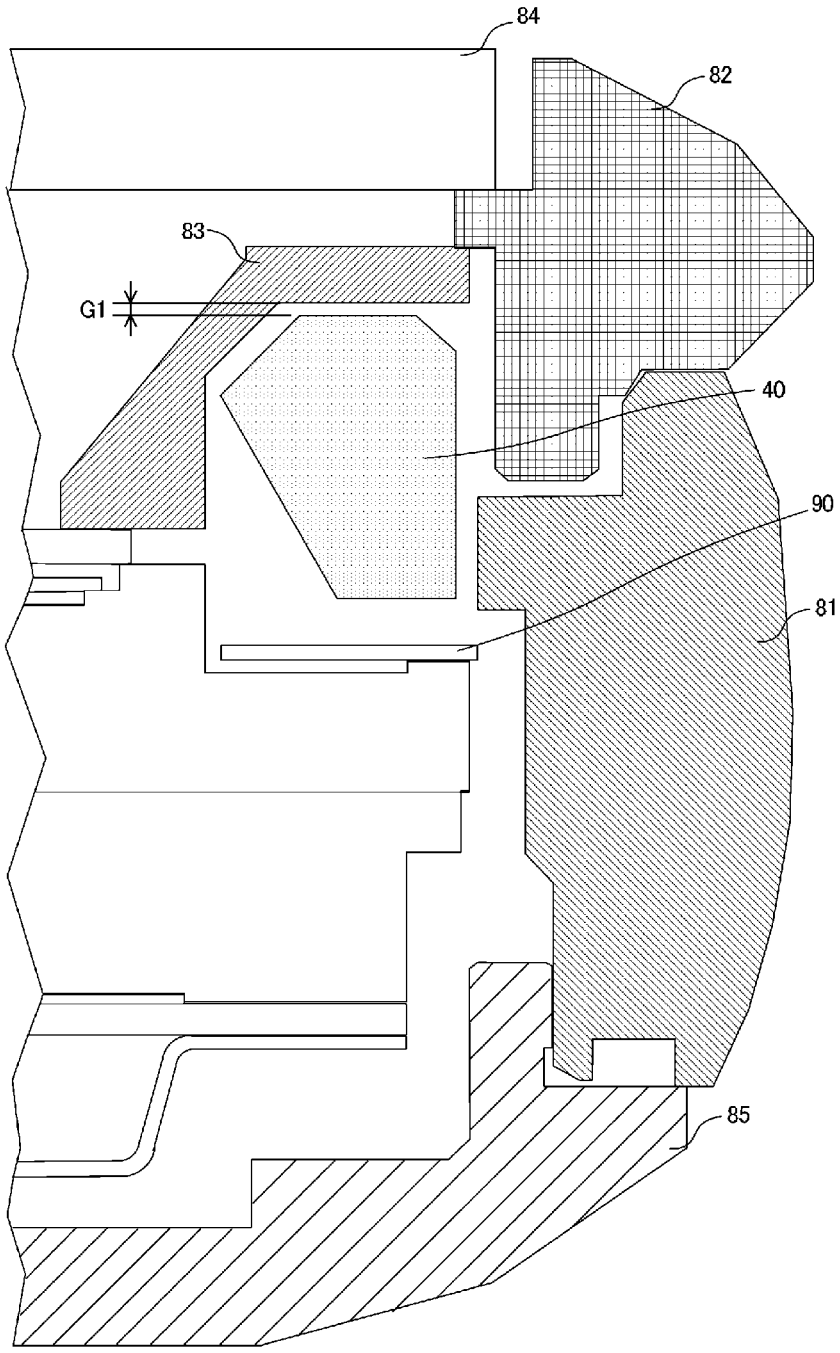
FIG. 13 is a partially cutaway cross-sectional view showing a portion that accommodates the ring antenna in the electronic timepiece 100.

Above the antenna body 40 in the vertical direction, the dial ring 83 is provided as a structure above the antenna body 40, as shown in FIG. 13. That is, the antenna body 40 is disposed in an accommodation space surrounded by the dial ring 83 and the glass frame 82. When an impact is applied to the timepiece or the timepiece vibrates, the position of the antenna body 40 may be shifted in the accommodation space.

Figure 14:
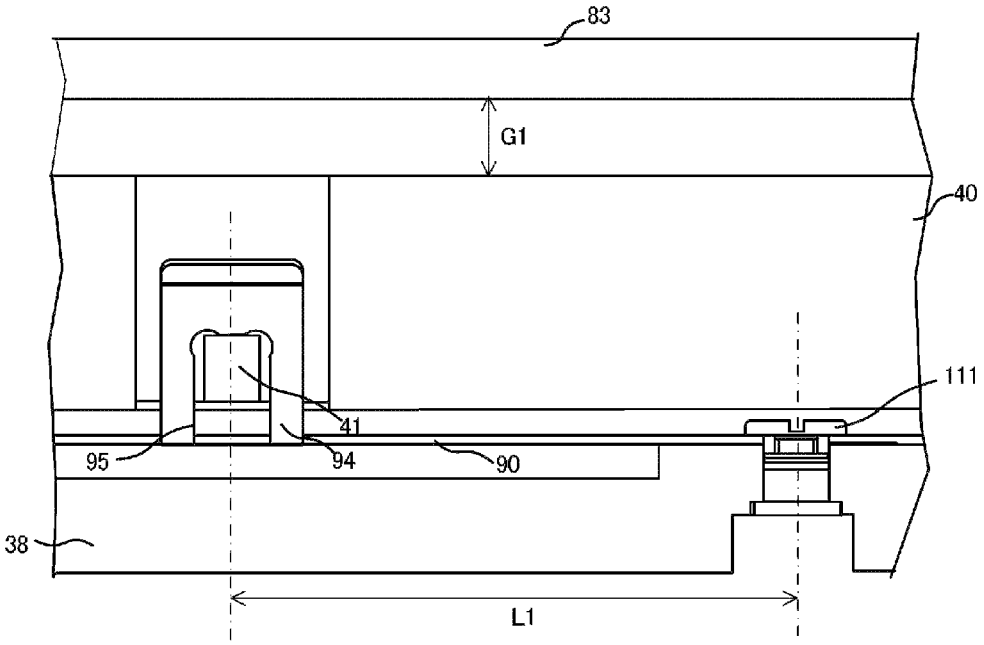
FIG. 14 is a partially cutaway cross-sectional view showing a fixing plate in a normal state of the electronic timepiece 100.

In the present embodiment, however, the distance from the engagement positions where the hooks 94 of the fixing plate 90 engage with the protrusions 41 of the antenna body 40 to the positions where the fixing plate 90 is attached to the main plate 38 with the screws 111 is set at a predetermined value L1 in the circumferential direction of the main plate 38, as shown in FIG. 14.

Figure 15:
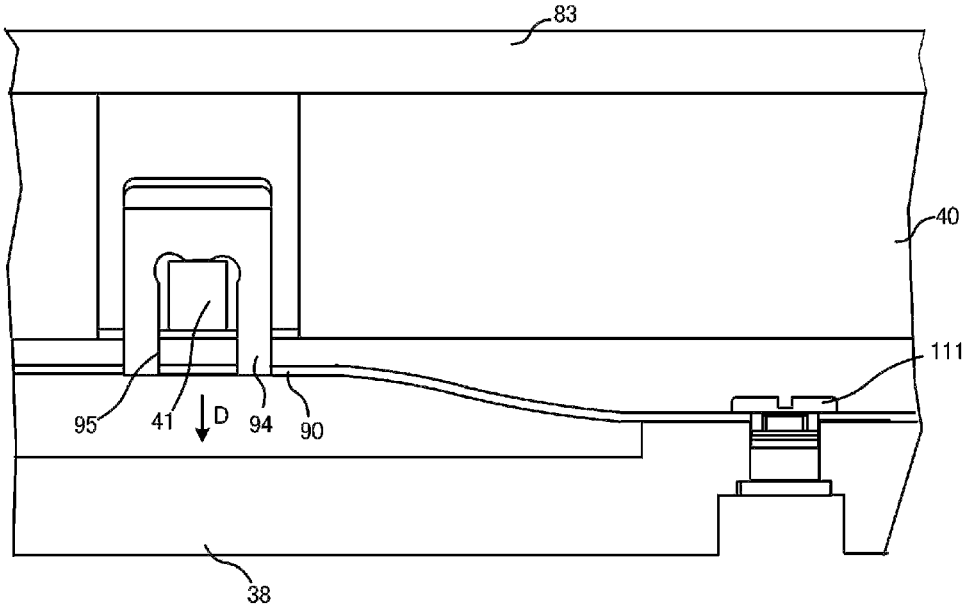
FIG. 15 is a partially cutaway cross-sectional view showing the fixing plate in a state in which the position of the antenna body is changed in the electronic timepiece 100.

The fixing plate 90 can therefore produce an elastic force, which urges the antenna body 40 in the direction indicated by the arrow D shown in FIG. 15 even when an impact or any other force displaces the antenna body 40 in the vertical direction as shown in FIG. 15. The urging force causes the antenna body 40 to return to its original position shown in FIG. 14.

Further, the gap G1 between the antenna body 40 and the dial ring 83, which is the structure above the antenna body 40, is set to a value within the range where the fixing plate 90 can produce an elastic force, as shown in FIG. 13.

That is, when the antenna body 40 is displaced from the position thereof in the normal state shown in FIG. 14 to the position in the state shown in FIG. 15, the upper surface of the antenna body 40 comes into contact with the lower surface of the dial ring 83.

The gap G1 between the antenna body 40 and the dial ring 83 is so set that the fixing plate 90 can produce an elastic force even when the upper surface of the antenna body 40 comes into contact with the lower surface of the dial ring 83 as described above. Therefore, the fixing plate 90 is not plastically deformed but produces an elastic force to cause the antenna body 40 to return to the position thereof in the normal state shown in FIG. 14.

As a result, an impact applied to the antenna body 40 is absorbed, whereby breakage of the antenna body 40 can be reliably avoided.

Further, in the present embodiment, the main plate perpendicular surface portions 120 are provided at five locations in the circumferential direction of the main plate 38, as shown in FIG. 9. Each of the main plate perpendicular surface portions 12 has a surface extending in the direction perpendicular to the surface of the main plate 38, as shown in FIG. 16.

Figure 16:
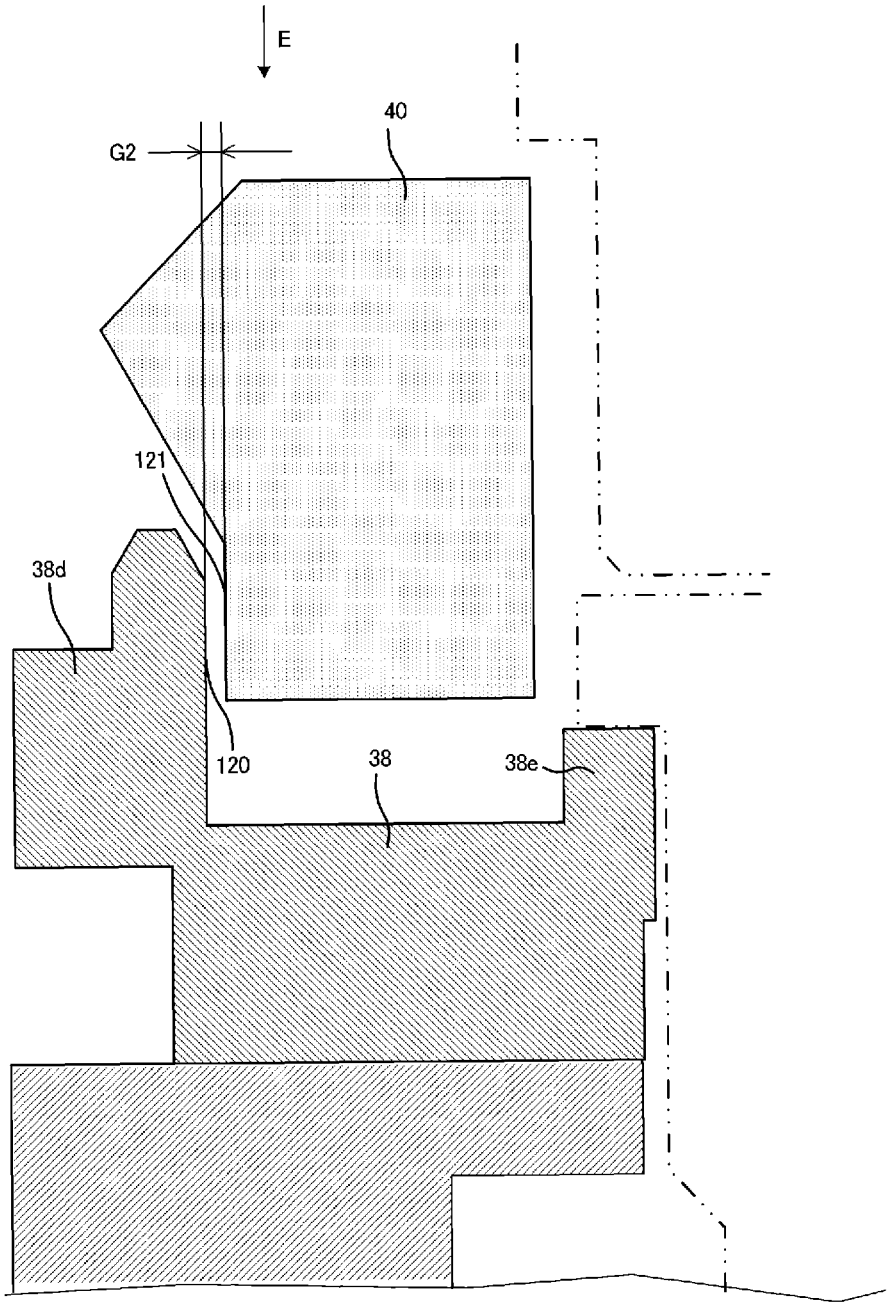
FIG. 16 is a partially cutaway cross-sectional view showing a portion in the vicinity of a portion where a main plate perpendicular surface portion and an antenna perpendicular surface portion face each other in the electronic timepiece 100.

Antenna perpendicular surface portions 121 are formed as part of the inner circumferential surface of the antenna body 40, as shown in FIG. 16. Each of the antenna perpendicular surface portions 121 also has a surface extending in the direction perpendicular to the surface of the main plate 38.

Figure 17:
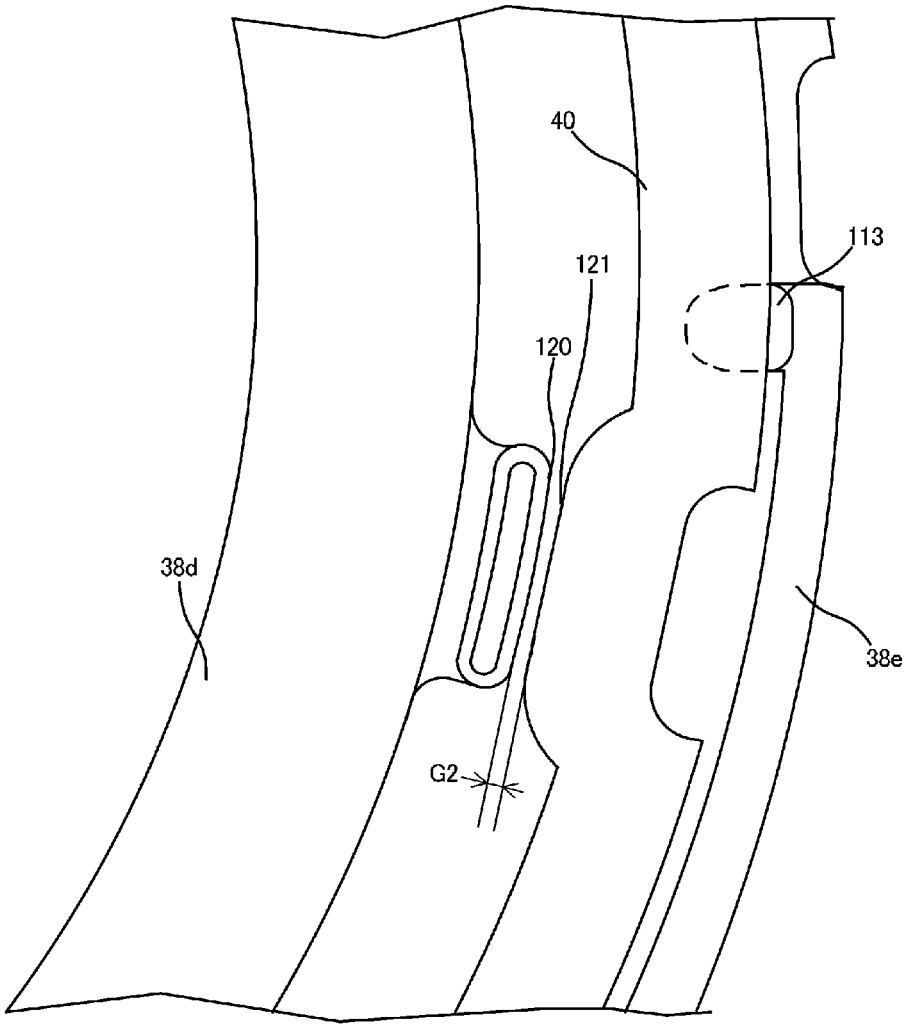
FIG. 17 is another partially cutaway cross-sectional view showing the portion in the vicinity of the portion where the main plate perpendicular surface portion and the antenna perpendicular surface portion face each other in the electronic timepiece 100.

When the antenna body 40 is attached to the main plate 38, the antenna perpendicular surface portions 121 are so positioned that they face the main plate perpendicular surface portions 120. FIG. 17 shows the portion viewed in the direction indicated by the arrow E shown in FIG. 16 where one of the antenna perpendicular surface portions 121 faces the corresponding main plate perpendicular surface portion 120. It is noted that the cross section of the antenna body 40 shown in FIG. 17 is taken at an appropriate position for ease of illustration.

In the present embodiment, a gap G2 between each of the antenna perpendicular surface portions 121 and the corresponding main plate perpendicular surface portion 120 is set to be smaller than a gap G3 between each of the recesses 42 of the antenna body 40 and the corresponding guide protrusion 112 of the antenna body shown in FIG. 10.

Therefore, even when the antenna body 40 is displaced in the planar direction of the main plate 38, the amount of displacement is limited by the main plate perpendicular surface portions 120 formed on the main plate 38, whereby breakage of the antenna body 40 is reliably avoided.

As described above, according to the present embodiment, even when the antenna body 40 is made of a composite material that is a combination of a dielectric material and a plastic material and formed to have a ring-like shape that cannot be fixed to a base with an adhesive, the amount of displacement of the antenna body 40 in the vertical direction and the planar direction can be reliably limited.

As a result, even when an impact is applied to the timepiece or the timepiece is caused to vibrate, breakage of the antenna body 40 in the accommodation space can be reliably avoided.

The numbers of threaded holes 110, antenna guide protrusions 112, seat portions 113, main plate perpendicular surface portions 120, and antenna perpendicular surface portions 121 in the present embodiment are presented by way of example, and the numbers are not limited to those described above and may be increased or decreased as appropriate.

The fixing plate 90 only needs to be a member capable of producing an elastic force and is not necessarily made of a metal.

The above embodiment has been described with reference to the case where the fixing plate has a ring-like shape, but the fixing plate may instead be divided as appropriate into portions that are then attached to the main plate. Further, the above embodiment has been described with reference to the case where the hooks each of which has a through hole formed therein are used, but the hooks are not necessarily shaped this way and only need to have a shape that can engage with the protrusions of the antenna body.

The invention claimed is:

1. An electronic timepiece with a built-in antenna comprising:

an exterior case;

a main plate disposed in the exterior case;

a ring-shaped antenna body disposed in the exterior case;

a reference surface that is formed on the main plate and positions the antenna body in a direction perpendicular to the main plate;

an urging member that engages with the antenna body to urge the antenna body in a direction perpendicular to the reference surface; and an engaging portion that is formed on the antenna body and engages with the urging member, wherein a predetermined gap is formed in a normal state between the antenna body and a structure disposed on an opposite side of the antenna body to the reference surface.

2. The electronic timepiece with a built-in antenna according to claim 1, further comprising:

a cover glass plate that blocks one of two openings of the exterior case having a tubular shape;

indication hands that are disposed in a portion inside an inner circumference of the antenna body and display time;

a circuit substrate which is provided in a position below the antenna body when viewed from the cover glass plate and on which a shield pattern is formed; and a receiver that is so provided on the circuit substrate that the receiver faces away from the antenna body with the shield pattern being a boundary and amplifies and processes a signal received by the antenna body.

3. The electronic timepiece with a built-in antenna according to claim 2, wherein the receiver is disposed in a position inside an inner circumference of the antenna body.

4. The electronic timepiece with a built-in antenna according to claim 2, further comprising:

a pair of feed points provided on the antenna body;

a pair of connection pins that connect the pair of feed points to the circuit substrate; and a balun so disposed on the circuit substrate that the balun and the receiver are present on the same side with the balun electrically connected to the pair of connection pins, wherein the receiver is disposed in a position closer to the center of the ring-shaped antenna body than the balun.

5. The electronic timepiece with a built-in antenna according to claim 4, wherein the balun is disposed in a position inside the inner circumference of the antenna body.

6. The electronic timepiece with a built-in antenna according to claim 1, wherein the gap is set at a value within a range over which the urging member elastically deforms when the antenna body is so displaced that the antenna body comes into contact with the structure.

7. The electronic timepiece with a built-in antenna according to claim 1, wherein the urging member is so attached to the main plate that the urging member is in intimate contact with the main plate partially in a circumferential direction of the main plate, and the position where the urging member is attached and the position where the urging member engages with the engaging portion of the antenna body are so set that the positions are kept apart from each other by a predetermined distance in the circumferential direction of the main plate.

8. The electronic timepiece with a built-in antenna according to claim 1, wherein the main plate has first guide engaging portions formed at a plurality of locations in a circumferential direction of the main plate, the antenna body has second guide engaging portions that engage with the first guide engaging portions, the main plate has main plate perpendicular surface portions that face an inner circumferential surface of the antenna body at a plurality of locations in the circumferential direction of the main plate, the antenna body has antenna perpendicular surface portions formed as part of the inner circumferential surface of the antenna body in positions that face the main plate perpendicular surface portions, and a gap between each of the main plate perpendicular surface portions and the corresponding antenna perpendicular surface portion is set to be smaller than a gap between each of the first guide engaging portions and the corresponding second guide engaging portion.

9. The electronic timepiece with a built-in antenna according to claim 8, wherein each of the first guide engaging portions is an antenna body guide protrusion that is formed to protrude from the main plate in a direction perpendicular thereto or in a radial direction thereof, and each of the second guide engaging portions is a recess that engages with the corresponding antenna body guide protrusion.

10. The electronic timepiece with a built-in antenna according to claim 1, wherein the urging member is a ring-shaped plate.

11. The electronic timepiece with a built-in antenna according to claim 3, further comprising:

a pair of feed points provided on the antenna body;

a pair of connection pins that connect the pair of feed points to the circuit substrate; and a balun so disposed on the circuit substrate that the balun and the receiver are present on the same side with the balun electrically connected to the pair of connection pins, wherein the receiver is disposed in a position closer to the center of the ring-shaped antenna body than the balun.

12. The electronic timepiece with a built-in antenna according to claim 11, wherein the balun is disposed in a position inside the inner circumference of the antenna body.

* * * * *